US005398606A

United States Patent [19]

Becker

[11] Patent Number: 5,398,606

[45] Date of Patent: Mar. 21, 1995

[54] DEVICE FOR ACTUATING CLAMPING MEMBERS OF A TURNING DEVICE BY REMOTE CONTROL

[75] Inventor: Willi Becker, Bammental, Germany

[73] Assignee: Heidelberger Druckmaschinen AG, Hiedelberg, Germany

[21] Appl. No.: 92,007

[22] Filed: Jul. 15, 1993

[30] Foreign Application Priority Data

Jul. 15, 1992 [DE] Germany ..... 42 23 189.2

[51] Int. Cl.[6] ..... B41F 1/30

[52] U.S. Cl. ..... 101/409; 101/415.1

[58] Field of Search ..... 101/409, 410, 415.1, 101/247, 230; 74/439, 519

[56] References Cited

U.S. PATENT DOCUMENTS 4,833,989 5/1989 Wieland ..... 101/410

5,136,946 8/1992 Becker ..... 101/247

FOREIGN PATENT DOCUMENTS 3814831 10/1989 Germany .

*Primary Examiner*—Eugene H. Eickholt

*Attorney, Agent, or Firm*—Herbert L. Lerner; Laurence A. Greenberg

[57] ABSTRACT

This invention concerns a device for remote-controlled operation of clamping elements of a turning device, especially in cylinders that carry sheets of paper and on the side walls of rotary printing presses. The turning device has at least one turning drum, one storage drum and adjustable toothed segments. These components in turn comprise clamping elements by means of which a clamp connection is created and maintained between force transmitting elements that are adjustable relative to each other and between control elements by having an initial tension force act on them. Control elements (20, 24; 46, 48) on which a hydraulic medium can act are arranged on movable pressure bars (9, 32, 39) consisting of at least one part. These move a transmission element (13, 32a, 40, 45) such that the clamping effects generated by the force storage devices (12) are cancelled out.

16 Claims, 5 Drawing Sheets

DEVICE FOR ACTUATING CLAMPING MEMBERS OF A TURNING DEVICE BY REMOTE CONTROL

This invention concerns a device for remote-controlled operation of clamping elements of a turning device, especially on cylinders that carry sheets of paper and on the side walls of rotary printing presses.

The state-of-the-art device for adjusting the rotational position of a cylinder of a turning device and for axial displacement of a control element for changing the settings of the gripper control on the cylinder of a sheet-fed letter press is disclosed in German Patent DE 3,814,831 C1. With this manually operated device, a threaded bushing designed with a socket wrench lug is rotated in order to decrease or completely eliminate the clamping force exerted by a spring package on pressure levers by way of a pressure ring. Furthermore, a double lever that can be operated in accordance with the axial position of the threaded bushing and a ring groove serves to interrupt the electric circuit when the clamping action between the fixed gear wheel and the adjusting gear wheel is stopped and to close the electric circuit when the action between the fixed gear wheel and the adjusting gear wheel is restored. One disadvantage of this device is that manual operation is required to release the clamping action and another disadvantage is that the electric circuit is interrupted mechanically.

In an improvement on the state of the art, the present invention is based on the problem of creating the prerequisites for a remote-controlled clamping device consisting of standardized compact components.

According to this invention, this object is achieved by arranging control elements that can be actuated by a hydraulic medium on movable pressure bars of at least one part, and having said control elements move a transmission element such that the clamping action generated by energy storing devices is cancelled out.

The advantages that can be achieved with the embodiment according to this invention consist of the fact that now it is possible to integrate the clamping devices on a turning device into a system for remote control of machines. If all the components—of a turning device, for example—are equipped with devices according to this invention, simultaneous remote control of different components is possible, so the setup times in changing from first form to first and second form are drastically reduced. In a further refinement of the idea on which the invention is based, a pressure chamber is formed between the ring-shaped bordering surfaces when the hydraulic medium acts on the control cylinders. No separate antechamber is needed for a buildup of pressure and therefore the control elements may be of an especially compact design. Furthermore, the volume of the medium required for the pressure buildup can be minimized. Another embodiment of the solution according to this invention provides for the movable pressure bars consisting of at least one part as part of control elements that are mounted in a stationary mount and can be actuated by a hydraulic medium to be secured in a rotating mount. It is especially advantageous that a separate and complicated rotary transmission lead-through can be omitted, which thus significantly reduces the manufacturing costs. There are no rotational movements in the area of the parts that border the pressure chamber, so there are no problems with regard to leakage and sealing.

In another embodiment of the solution according to this invention, bearing elements can be used in the control elements that can be actuated by a hydraulic medium. Thus, these bearing elements can be used on both rotating and non-rotating pressure bars without necessitating any changes in the geometry of the control elements. Therefore, they can be used universally and can be produced in large numbers, which greatly reduces the manufacturing cost.

According to another embodiment of the idea on which this invention is based, the control elements that can be actuated by a hydraulic medium are held directly by a movable pressure bar consisting of at least one part. In this embodiment, separate bearing elements are unnecessary, but the configuration of the control elements is retained for this application.

In another embodiment of the object of this invention, control elements that can be actuated indirectly by a hydraulic medium are arranged on a movable pressure bar consisting of at least one part, and these control elements move a transmission element such that the clamping effect produced by the energy storing devices is rendered ineffective. Since control elements that can be operated indirectly by means of a hydraulic medium are used here, small, compact control elements of a hydraulic type or a pneumatic type may be used thanks to suitable dimensions of the parts with regard to pressure surfaces and lever ratios, which are mentioned here only as representative of other parameters. According to one embodiment of this concept of the object of this invention, the control element that can be operated indirectly by way of a hydraulic medium holds an eccentric pin that is connected by a lever to a control cylinder. In this variant, the periphery of the pressure generating system may be mounted outside the clamp to be operated.

According to another embodiment of this concept, a pressure bar consisting of at least one part is mounted so it can rotate and move axially in a pin suspension. In addition, the pin suspension has a radial bearing and rests against a stop when the eccentric pin is twisted on an axial bearing. Due to a control force, although small, applied to the end of a lever, the spring force of an energy storing device can be cancelled with a minimum control path, so an adjusting operation can be carried out.

This invention will now be explained in greater detail with reference to the figures, which show the following:

Figure 1:
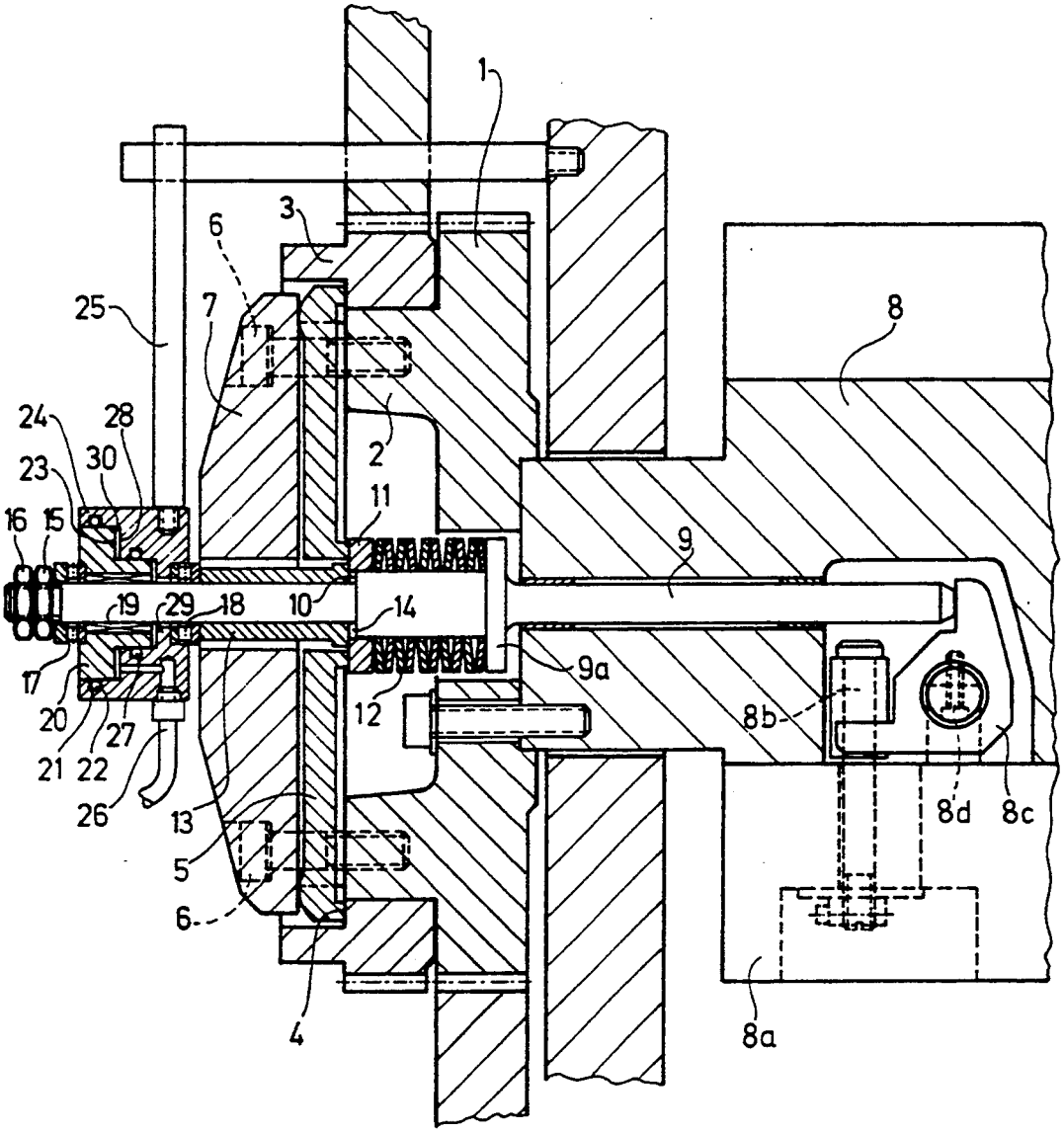
FIG. 1 shows a cross section through a remote-controlled control element that can be actuated by means of a hydraulic medium on a rotating pressure bar.

FIG. 1 shows a cross section through a remote-controlled control element that can be actuated by a hydraulic medium on a rotating pressure bar. In order to maintain the frictional connection between a fixed gear wheel 1 and an adjusting gear wheel 3, they are locked in position relative to each other by means of pressure levers 5. Pressure levers 5 press the adjusting gear wheel 3 that is held on an axle 2 against a fixed gear wheel and in doing so they act on ring surface 4. The pressure levers 5 are supported on a supporting plate 7 that is bolted to axle 2 with bolts 6. Pressure levers 5, which are subdivided into a short lever arm and a long lever arm, are in contact with a disk 11 along each lower lever arm. Between disk 11 and shoulder 9*a* of pressure bar 9 there is a spring package 12 that produces the initial tension force required to maintain the clamping effect. This acts on the lower lever arms of pressure levers 5 on the one hand, so the pressure levers are supported on supporting plate 7 by way of a cam on the back of pressure lever 5. Fixed gear wheel 1 and adjusting gear wheel 3 are clamped with respect to each other by the short lever arm of pressure lever 5—with the clamping force thereby increased in accordance with the lever ratios. On the other hand, a pressure lever 8*c* mounted on a hinge pin 8d is provided inside of cylinder 8. When pressure bar 9 presses against pressure levers 8*c*, the latter secure the adjusting carriage 8*a* in its position on cylinder 8 by means of tension pins 8*b*.

At the end of pressure bar 9 there are two nuts 15, 16, where nut 15 forms a stop that is secured by lock nut 16 by means of an axial bearing 17 and a radial bearing 19, and piston 20 is held on pressure bar 9 in such a way that it does not rotate but can be shifted axially in housing 24. Housing 24 holds an axial bearing 18 in a recess on the side of the pressure bar and is connected in a non-rotational mount to the side wall of the machine by way of a locking device 25. Pressure bushing 13 that can move in the axial direction on pressure bar 9 is in contact with a ring of the axial bearing 18. There is some play between the end of the pressure bushing on the side of the spring package and the shoulder 10 of pressure bar 9, thus allowing the control path 14. Housing 24 has a ring groove 21 in which a sealing element 22 is placed. Bordering wall 23 of piston 20 forms a border of pressure chamber 30. Housing 24 has an inlet line 26 for a hydraulic medium and has another sealing element 27 which together with sealing element 22 seals off pressure chamber 30 between piston 20 and housing 24, i.e., the parts that can move relative to each other, and thus makes it possible for a pressure to build up. Housing 24 with its bordering surface 28 completes the ring-shaped pressure chamber 30 running between piston 20 and housing 24 on which a hydraulic medium acts by way of inlet line 26. The recess to receive the axial bearing 18 is bordered by projection 29 on housing 24.

Since the hydraulic medium line runs through housing 24 which cannot rotate but can be shifted axially, it is not necessary to use a complex rotary transmission lead-through, which usually also involves sealing problems. With the embodiment according to this invention, the pressure buildup takes place between two components that cannot rotate—namely, piston 20 and housing 24 where there is not any problem in sealing them with respect to each other. When actuated by a hydraulic medium, an excess pressure builds up in pressure chamber 30, which is formed by the bordering surfaces 23 and 28. Piston 20 is supported on stop 15 which is secured by lock nut 16 by way of the axial bearing 17. At the same time, housing 24 moves in the axial direction toward spring package 12 in accordance with the buildup of pressure in pressure chamber 30. The displacement of pressure bushing 13, which is in contact with disk 11, takes place by way of axial bearing 18 in accordance with the displacement of housing 24. As soon as the control path 14 has been traversed, pressure bushing 13 is in contact with a shoulder 10 of pressure bar 9 that holds springs 12. At the same time as the pressure bushing 13 comes to rest on shoulder 10 of pressure bar 9, the initial tension created by springs 12 is eliminated by means of disk 11 which can also be displaced axially. Pressure levers 5 and 8*c* are also released. Now there can be an adjustment of the rotational position of the adjusting gear wheel 3 relative to the fixed gear wheel 1 and an adjustment of the adjusting carriage 8*a*. The machine is secured during the conversion phase by means of a pressure monitor integrated into the supply line 26 for the hydraulic medium, keeping the electric circuit interrupted during the pressure buildup phase so the machine cannot be started when the clamping mechanism is not in effect. This eliminates the need for a limit switch assembly.

Figure 2:
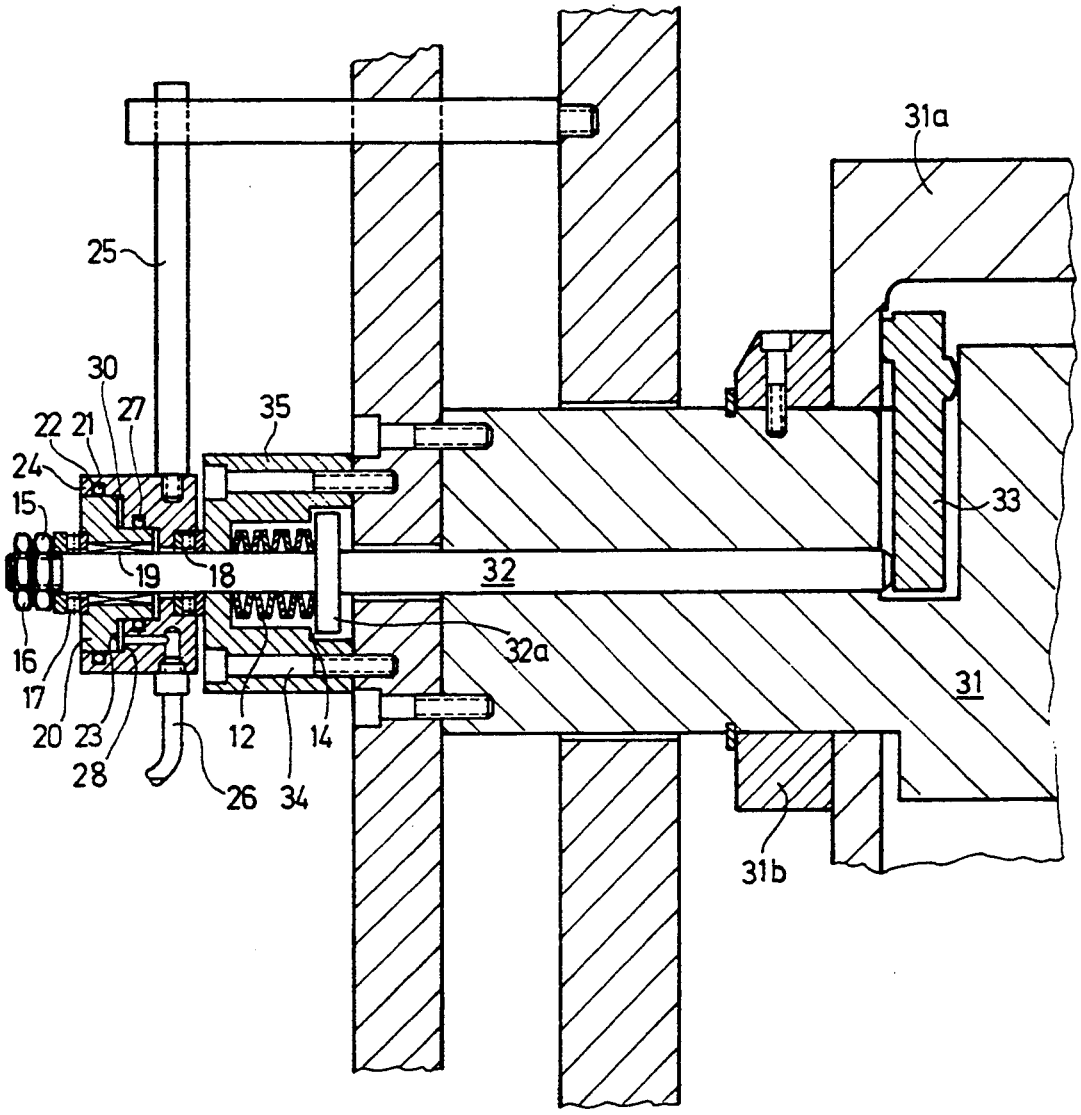
FIG. 2 shows a section through a device that is flange mounted on a storage drum for remote-controlled operation of clamping elements.

FIG. 2 shows a cross section through a device that is flange connected to a storage drum for the purpose of re-mote-controlled operation of clamping elements.

To clamp a jacket 31*a* of a storage drum 31 against a stop 31*b* arranged on the axle of storage drum 31, a spring package 12 is supported on housing 35. Housing 35 is flange connected by bolts 34 to storage drum 31. The spring package presses a pressure bar 32 against a lever arm of pressure lever 33 which is longer with respect to a cam for support by way of a shoulder 32*a*. The shorter lever arm of pressure lever 33 presses the jacket 31*a* of storage drum 31 against stop 31*b* which is attached to the lug of storage drum 31.

Piston 20 and housing 24 are mounted on pressure bar 32 by way of the axial bearings 17 and 18 and radial bearing 19—like the diagram shown in FIG. 1. Piston 20 rests by way of axial bearing 17 against stop 15 which is secured by lock nut 16. Housing 24 is attached to the side wall through the locking device 25 and holds piston 20 so that it cannot rotate but it can move axially. Pressure chamber 30 is formed by two ring-shaped bordering faces 23 and 28 of piston 20 and housing 24. Pressure chamber 30 is sealed in a manner suitable to permit a buildup of pressure by means of sealing element 22 in ring groove 21 of piston 20 on the one hand and by sealing element 27 of housing 24 on the other hand.

When pressure acts on pressure chamber 30 through the inlet line for hydraulic medium 26 in this embodiment, piston 20 comes out of housing 24 and comes to rest against stop 15 of pressure bar 32 at the beginning of the pressure buildup. With a further increase in pressure, pressure bar 32 is pushed to the left until shoulder 32*a* of pressure bar 32 comes to rest against a stop in housing 35 after traveling the control distance 14. Thus, pressure lever 33 is released at its lower end and the clamping effect between jacket 31*a* and stop 3l*b* of storage drum 31 is eliminated. Now an adjustment can be performed.

It can be seen from a comparison with FIG. 1 that the geometric arrangements of the control elements, in other words, piston 20 and housing 24, are identical. This means that these components have universal applicability for use on several different parts of a turning device. Furthermore, if the storage drum and turning drum are equipped with devices according to this invention, several components can be operated simultaneously. In addition, machines and printing presses that have already been shipped and installed can also be retrofitted with the embodiments illustrated in FIGS. 1 and 2, so the potential for economization inherent in the device according to this invention can be utilized even on such rotary printing presses that have already been installed.

Figure 3:
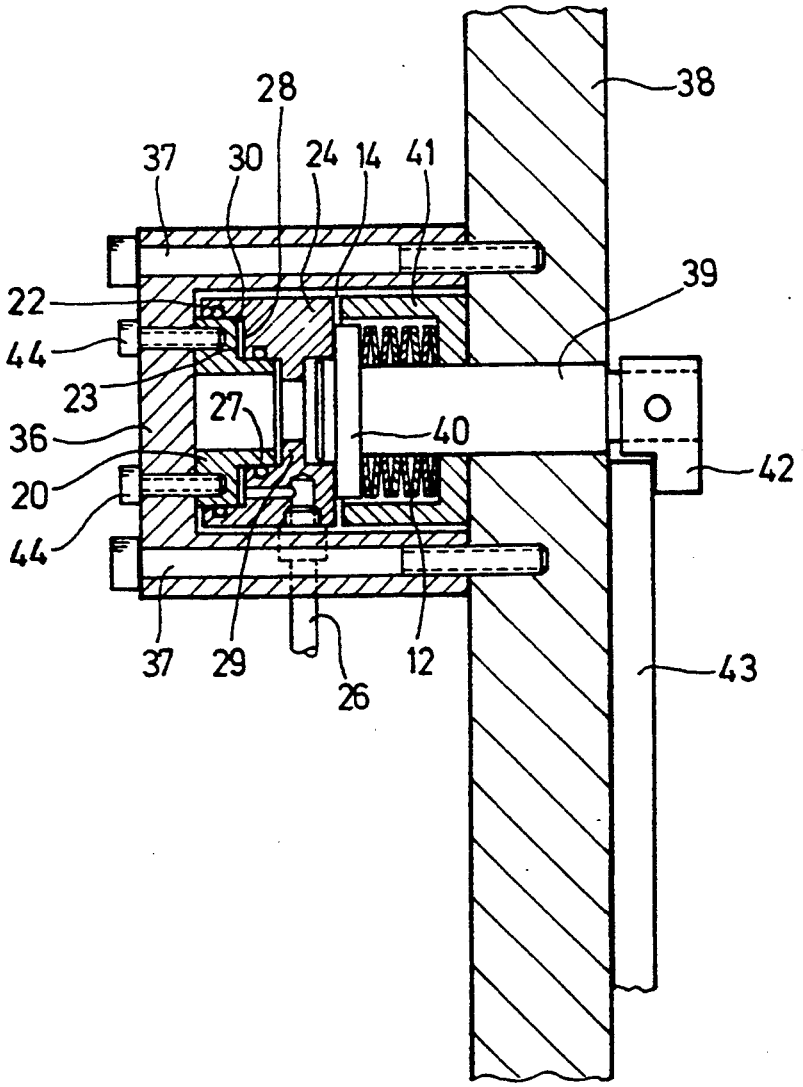
FIG. 3 shows a cross section through a device for remote-controlled operation of a clamping device for a toothed segment mounted on the side wall of a rotary printing press.

FIG. 3 shows a section through a device for remote-controlled operation of a clamp for a toothed segment mounted in an adjustable manner on a side wall of a rotary printing press.

In this embodiment, a bell-shaped body 36—or a suitably shaped strap—is provided on side wall 38 of a rotary printing press. The bell-shaped body 36 may be attached to side wall 38 with bolts 37. To save on space, however, it may also be inserted into the side wall, which thus makes it possible to shorten the length of pressure bar segment 39. There is a shoulder 40 on pressure bar segment 39. At least one spring 12 is provided between shoulder 40 and stop 41 that is in a stationary position on the housing and limits the control path 14. Piston 20 is connected by bolts 44 to the bell-shaped body 36, while housing 24 is centered on the end of the pressure bar segment 39 and rests with a shoulder on 40.

Pressure bar segment 39 is provided with a projection 42 on the rear part which faces toothed segment 43. This projection 42 clamps against side wall 38 or releases it for the purpose of adjustment with a movement of pressure bar segment 39 in the axial direction.

When pressure acts on the pressure chamber 30 formed by the ring-shaped bordering surfaces 23 and 28, housing 24 moves in the axial direction away from piston 20. When housing 24 comes to rest against shoulder 40 of pressure bar segment 39, this causes compression of springs 12 with an axial movement of pressure for segment 39 due to the pressure acting on pressure chamber 30. With an axial movement of pressure bar segment 39, projection 42 releases toothed segment 43, which can then be adjusted. When the pressure is relieved on chamber 30, the projection is pressed against the toothed segment 44 by means of springs 12, so its swivel position is locked. When pressure acts on pressure chamber 30, the control path 14 is determined by stop 41. The short control path in this configuration can readily be lengthened to a greater distance with different structural arrangements of the device according to this invention. As already pointed out with regard to the embodiments shown in FIGS. 1 and 2, piston 20 and housing 24 are provided with sealing elements 22 and 27 that are held in ring grooves in order to assure a buildup of pressure in the pressure chamber.

The embodiments illustrated in FIGS. 1 to 3 show installations for the housing 24 and piston 20 which are held in one case by rotating pressure bars 9 and 32 and bearing elements, whereas FIG. 3 shows an arrangement on a non-rotating pressure bar segment 39. This shows the universal applicability of the control elements, which thus makes it possible to equip several components of a turning device and also makes it possible to operate them by remote control by pushbutton at the same time.

Figure 4:
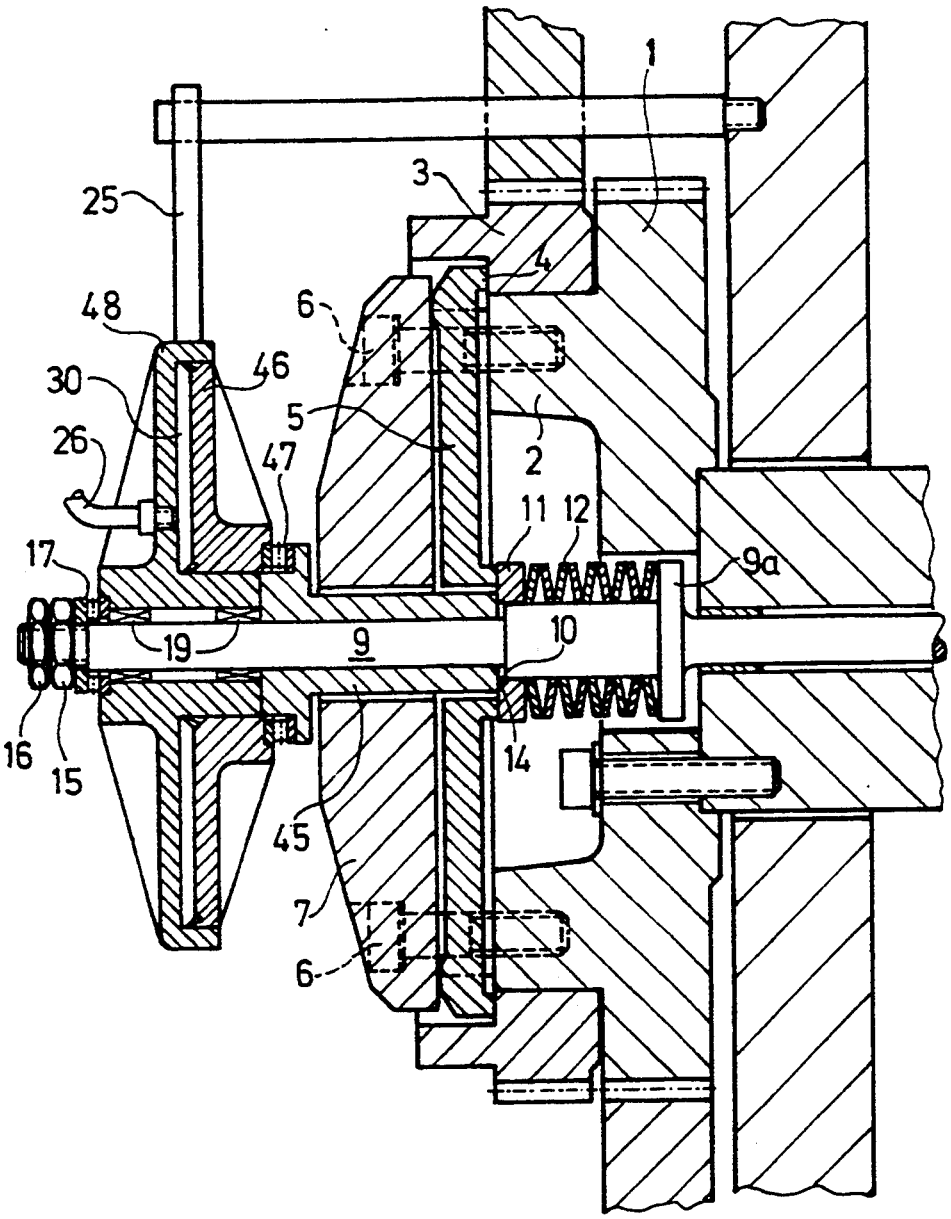
FIG. 4 shows a side view through a pneumatically operated device.

FIG. 4 shows a cross section through a device that can be operated pneumatically. In deviation from the embodiments of the device according to this invention described so far, components with larger pressure chamber bordering surfaces are illustrated in this variant. A rotating pressure bar 9 is held so it can rotate in housing 48 by means of radial bearings 19, while a piston 46 acts on a pressure bushing 45 by way of an axial bearing 47. When pressure acts on pressure chamber 30, it first causes housing 48 to come to rest against stop 15 by way of axial bearing 17, but secondly, piston 46 causes pressure bushing 45 to move in the direction of disk 11 by way of axial bearing 47. After pressure bushing 45 has been displaced by the length of the control path 14, the force applied to pressure levers 5 by means of springs 12 is eliminated and it is then possible to adjust the rotational position of the adjusting gear wheel 3.

This variant is intended for robotic applications where compressed air is used in the periphery and when enough space is available. In this variant the possible uses are greatly expanded by means of a combination with a hydraulically operated variant.

Figure 5:
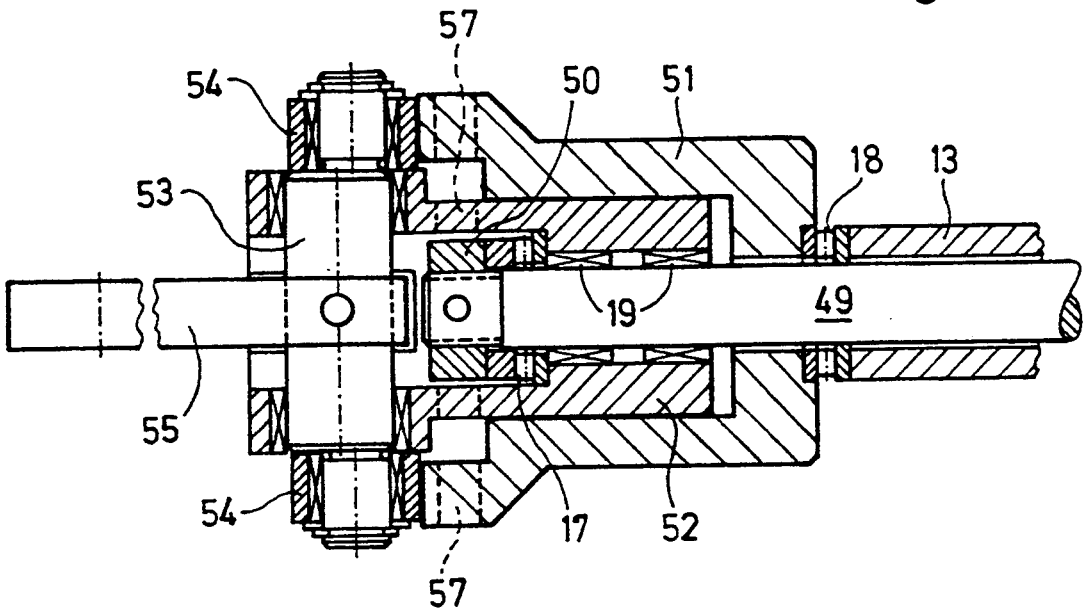
FIG. 5 shows a section through the control elements that can be operated indirectly by way of a hydraulic medium.
Figure 6:
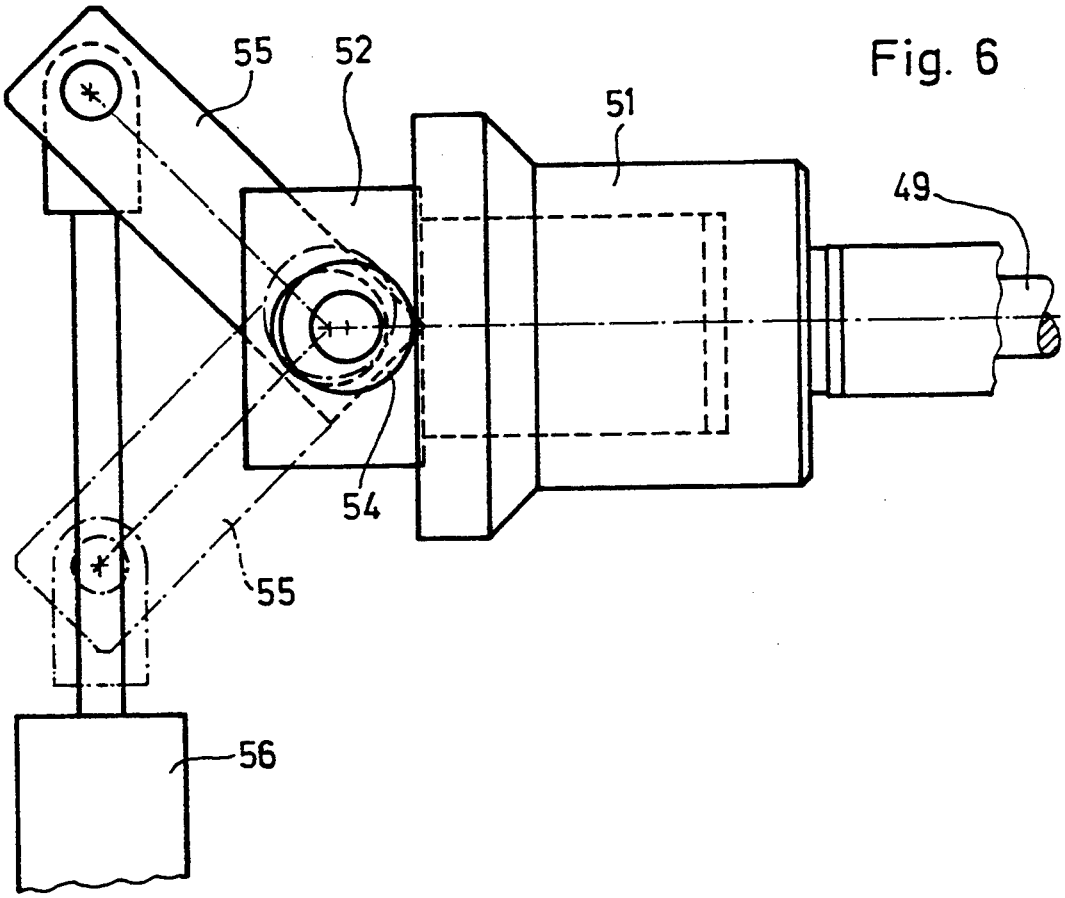
FIG. 6 shows a top view of a device according to FIG. 5.

Finally, FIGS. 5 and 6 show a cross section and a top view of control elements that can be operated indirectly by means of a hydraulic medium.

A pin suspension 52 is mounted on rotating pressure bar 49 in such a way that it can rotate by means of radial bearing 19. Furthermore, an axial bearing 17 is provided between a threaded ring 50 and the pin suspension 52. By means of roller bearings, the pin suspension holds an eccentric pin 53 which is in turn equipped with one roll 54 on each end. At the center, eccentric pin 53 is provided with a lever 55, at the end of which an adjusting movement takes place by means of a conventional commercial control cylinder 56. A control element 51 is centered on the pin suspension 52 and has eccentrically mounted rolls 54 in contact with its end faces.

In order to prevent twisting about threaded ring 50 when assembled over a pin, boreholes 57 that allow access to threaded ring 50 are provided in control element 51 and in the pin suspension 52. Eccentric pin 53 is twisted by a swivel movement of lever 55 that is triggered by pressure acting on control cylinder 56. Rolls 54 act on the end faces of control element 51 and cause it to shift in the axial direction—relative to the pin suspension 52 and the pressure bar 49. A pressure bushing 13 is shifted axially by means of axial bearing 18 in such a way that it can eliminate the initial tension of a spring package—as in the embodiments outlined above—and it initiates the performance of an adjusting operation. Through a suitable choice of the lever ratios in this variant that can be operated indirectly by means of a hydraulic medium, large control forces can be generated with small control cylinders 56.

I claim:

1. In a sheet turning device of the type having components in the form of at least one turning drum, one storage drum with a toothed gear and adjustable toothed segments meshing with the toothed gear of the storage drum, and clamping elements operatively associated with the components, wherein the clamping elements are subjected to a pretension force and maintain a clamping connection between the toothed gear of the storage drum and a gear of an impression cylinder and, upon releasing of the clamping connection, the clamping elements allow an adjustment of the storage drum relative to the impression cylinder, a device for controlled operation of the clamping elements, the device comprising:

a movable pressure rod and an energy storing device acting on said pressure rod for applying a biasing force on said pressure rod in a given direction, control members operatively associated with said pressure rod, and pressure means acting on said control members for acting on said pressure rod opposite the given direction and overcoming the biasing force of said energy storing device.

2. The device according to claim 1, including a transmission element upon which said pressure means can act, said transmission element transmitting a force from said pressure means to said energy storing device.

3. The device according to claim 1, including annular bordering surfaces formed on said control members, said annular bordering surfaces defining a hydraulic medium pressure chamber therebetween when said hydraulic medium acts on said control elements.

4. The device according to claim 3, including a feed line communicating with said pressure chamber for feeding pressure medium into said pressure chamber, and a pressure monitor connected in said feed line for monitoring a pressure in said pressure chamber.

5. The device according to claim 1, wherein said control members are non-rotatably mounted and said control members are indirectly held on said movable pressure rod.

6. The device according to claim 6, including bearing elements integrated in said control members.

7. The device according to claim 1, wherein one of said control members is acted on by a hydraulic mediums and is mounted directly on said movable pressure rod.

8. The device according to claim 1, wherein one of said control members is actuated by a hydraulic medium and is in contact with said movable pressure rod.

9. The device according to claim 8, wherein said one of said control members is centrally disposed about and guided by said movable pressure rod.

10. In a sheet turning device of the type having components in the form of at least one turning drum, one storage drum with a toothed gear and adjustable toothed segments meshing with the toothed gear of the storage drum, and clamping elements operatively associated with the components, wherein the clamping elements are subjected to a pretension force and maintain a clamping connection between the toothed gear of the storage drum and another gear and, upon releasing of the clamping connection, the clamping elements allow an adjustment of the toothed gear of the storage drum relative to the other gear, a device for controlled operation of the clamping elements, the device comprising:

a movable pressure rod and an energy storing device acting on said pressure rod for applying a biasing force on said pressure rod in a given direction, control elements associated with said movable pressure rod and a transmission element disposed between said energy storing device and said control elements, for transmitting forces between said energy storing device and said control elements, pressure means fluidically communicating with said control elements for actuating said control elements with a pressure medium and for moving said transmission element in such a way that clamping effects caused by said energy storing device are cancelled out.

11. The device according to claim 10, wherein said control elements include an eccentric bolt a rotation of which causes said pressure rod to move axially, and said pressure means include a control cylinder and a lever connected between said control cylinder and said eccentric bolt.

12. The device according to claim 10, including a trunnion bearing rotatably supporting said movable pressure rod.

13. The device according to claim 11, wherein said eccentric bolt has two ends, and including two rollers respectively disposed on said ends of said eccentric bolt.

14. The device according to claim 12, including a stop formed on said pressure rod, said trunnion bearing coming to rest against said stop when said eccentric bolt is rotated.

15. The device according to claim 14, including a radial bearing formed around said pressure rod and an axial bearing disposed between said stop and said trunnion bearing.

16. In a sheet turning device of a rotary printing press, the turning device being of the type having components in the form of at least one turning drum, one storage drum and adjustable toothed segments meshing with the toothed gear of the storage drum, and clamping elements disposed on a sheet-carrying cylinder and at side walls, respectively, of the rotary printing press, the clamping elements being operatively associated with the components, and means for subjecting the clamping elements to a pretension force and for maintaining a clamping connection between mutually adjustable elements, a device for remote-controlled operation of the clamping elements, the device comprising:

a movable pressure rod and an energy storing device acting on said pressure rod for applying a biasing force on said pressure rod in a given direction, control members operatively associated with said pressure rod, and pressure means acting on said control members for acting on said pressure rod opposite the given direction and overcoming the biasing force of said energy storing device.

* * * * *